US011066774B2

(12) United States Patent
Rios Acebal

(10) Patent No.: US 11,066,774 B2
(45) Date of Patent: Jul. 20, 2021

(54) LAUNDRY TREATING APPLIANCE AND DISPENSER FOR TREATING CHEMISTRIES

(71) Applicant: WHIRLPOOL CORPORATION, Benton Harbor, MI (US)

(72) Inventor: Marcos Javier Rios Acebal, Monterrey (MX)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/708,722

(22) Filed: Dec. 10, 2019

(65) Prior Publication Data

US 2020/0208330 A1 Jul. 2, 2020

Related U.S. Application Data

(60) Provisional application No. 62/785,720, filed on Dec. 28, 2018.

(51) Int. Cl.
*D06F 39/02* (2006.01)

(52) U.S. Cl.
CPC ..... *D06F 39/024* (2013.01)

(58) Field of Classification Search
CPC ..... D06F 39/024; D06F 39/022; D06F 39/02
See application file for complete search history.

(56) References Cited

U.S. PATENT DOCUMENTS

| | | | |
|---|---|---|---|
| 6,826,933 B2 | 12/2004 | Merkle et al. | |
| 7,770,418 B2 | 8/2010 | Kramme et al. | |
| 8,196,441 B2 | 6/2012 | Hendrickson et al. | |
| 9,340,919 B2 | 5/2016 | Kim | |
| 9,689,105 B2 | 6/2017 | Martinez Villarreal | |

FOREIGN PATENT DOCUMENTS

| | | | |
|---|---|---|---|
| EP | 1764437 B1 * | 3/2008 | ..... D06F 39/02 |
| GB | 2161838 A | 1/1986 | |

* cited by examiner

*Primary Examiner* — Michael E Barr
*Assistant Examiner* — Pallavi Chitta
(74) *Attorney, Agent, or Firm* — McGarry Bair PC

(57) ABSTRACT

A dispenser for the laundry treating appliance has a siphon for handling liquid treating chemistries and a float mechanism for handling solid treating chemistries, especially in the form of powders, in the same chamber. The dispenser can thus be operable for either or both types of treating chemistries with a single chamber and without having to reconfigure anything.

23 Claims, 7 Drawing Sheets

LAUNDRY TREATING APPLIANCE AND DISPENSER FOR TREATING CHEMISTRIES

CROSS-REFERENCE TO RELATED APPLICATIONS

This application claims the benefit of U.S. Provisional Patent Application No. 62/785,720, filed Dec. 28, 2018, which is incorporated herein by reference in its entirety.

BACKGROUND

Laundry treating appliances, such as clothes washers, refreshers, and non-aqueous systems, may be a common convenience in many homes. A user simply loads the cleaning appliance with laundry to be treated into a treating chamber, along with an optional supply of a treating chemistry, such as detergents, bleach, enzymes, and anti-spotting agents and selects and initiates a cleaning cycle that is subsequently automatically carried out by the cleaning appliance. An example of a typical cleaning cycle includes the washing of the laundry with liquid and optional treating chemistry and rinsing the laundry with liquid. Cleaning appliances may be provided with a dispenser for automatically dispensing one or more treating chemistries during a cleaning cycle. Generally, treating chemistries will come in one of two phases: liquids or solids. Solids mostly appear in the form of powders that are placed into a dispenser.

Conventionally, there have primarily been two ways in which washing machines were constructed to account for the difference between dispensing powder and liquid treating chemistries. The first way was to construct a washing machine with separate chambers for each type, liquid and powder. This was bulky and expensive to manufacture. The second way was to construct a washing machine with a single chamber that allows for liquid or powder treating chemistries; however, prior to adding the treating chemistry the user had to physically switch the position of a barrier between two pre-set positions to reflect what type of treating chemistry the user was planning to add. More specifically, the barrier had to be moved to make the chamber larger for powdered chemistry and smaller for liquid chemistries. In such a second construction, holes and guides for aiding in positioning the barrier caused loss of chemistry prior to the start of the cycle.

BRIEF SUMMARY

In one aspect, the present disclosure relates to a laundry treating appliance comprising a laundry treating chamber, a treating chemistry dispenser comprising, a container defining a treating chemistry receiving chamber and having a siphon outlet fluidly coupled to the treating chamber and a drain outlet fluidly coupled to the treating chamber, a siphon located in the receiving chamber and selectively fluidly coupling the siphon outlet to the treating chamber when liquid in the receiving chamber reaches a first level, a float located in the receiving chamber and selectively fluidly coupling the drain outlet to the treating chamber when liquid in the receiving chamber reaches as second level, greater than the first level.

In another aspect, the present disclosure relates to a treating chemistry dispenser comprising a container defining a treating chemistry receiving chamber and having a siphon outlet and a drain outlet, a siphon located in the receiving chamber and selectively fluidly coupling the siphon outlet to the receiving chamber when liquid in the receiving chamber reaches a first level, a float located in the receiving chamber and selectively fluidly coupling the drain outlet to the receiving chamber when liquid in the receiving chamber reaches a second level, greater than the first level.

DETAILED DESCRIPTION

Aspects of the disclosure relate to a laundry treating appliance having a dispenser that is capable of dispensing both liquid and powder treating chemistries from the same receptacle or repository. As the dispenser does not require alternative configurations for the liquid and powder dispensing, this leads to increased user satisfaction. Further still the dispenser avoids loss of treating chemistry prior to the beginning of the cycle as has been a problem in previous designs.

Figure 1:
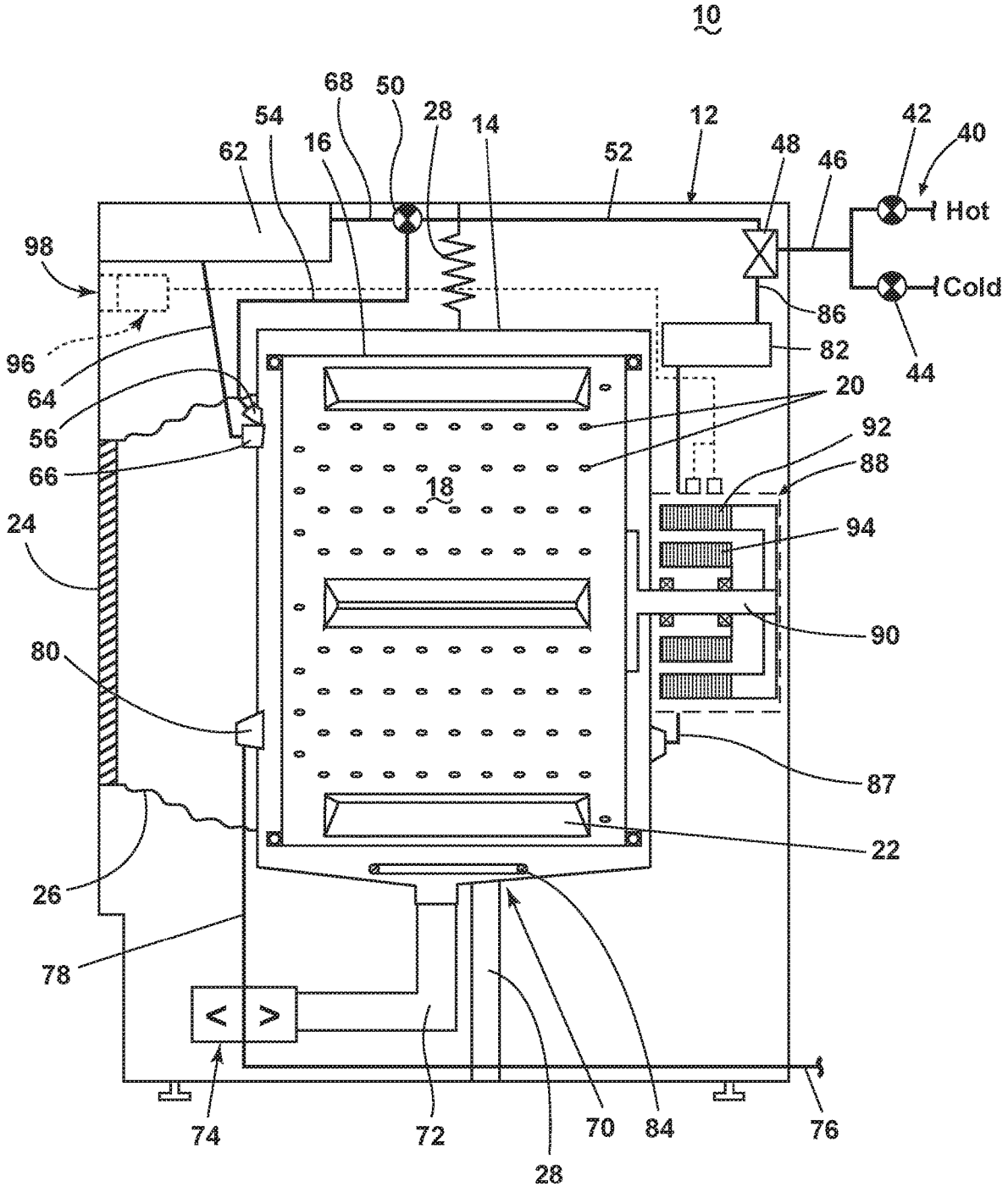
FIG. 1 is a schematic view of a laundry treating appliance in the form of a washing machine according to an aspect of the disclosure.

FIG. 1 is a schematic view of a laundry treating appliance according to a first embodiment of the invention. The laundry treating appliance may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the invention for the laundry holding system to comprise only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include at least one receptacle 62 that stores a single dose of treating chemistry that the dispensing system dispenses to the treating chamber and/or the drum 16, as part of the execution of the cleaning cycle. As used herein, the term "single dose of treating chemistry" and variations thereof, refers to an amount of treating chemistry sufficient for one cleaning cycle of the automatic clothes washing machine 10.

The dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88, which may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
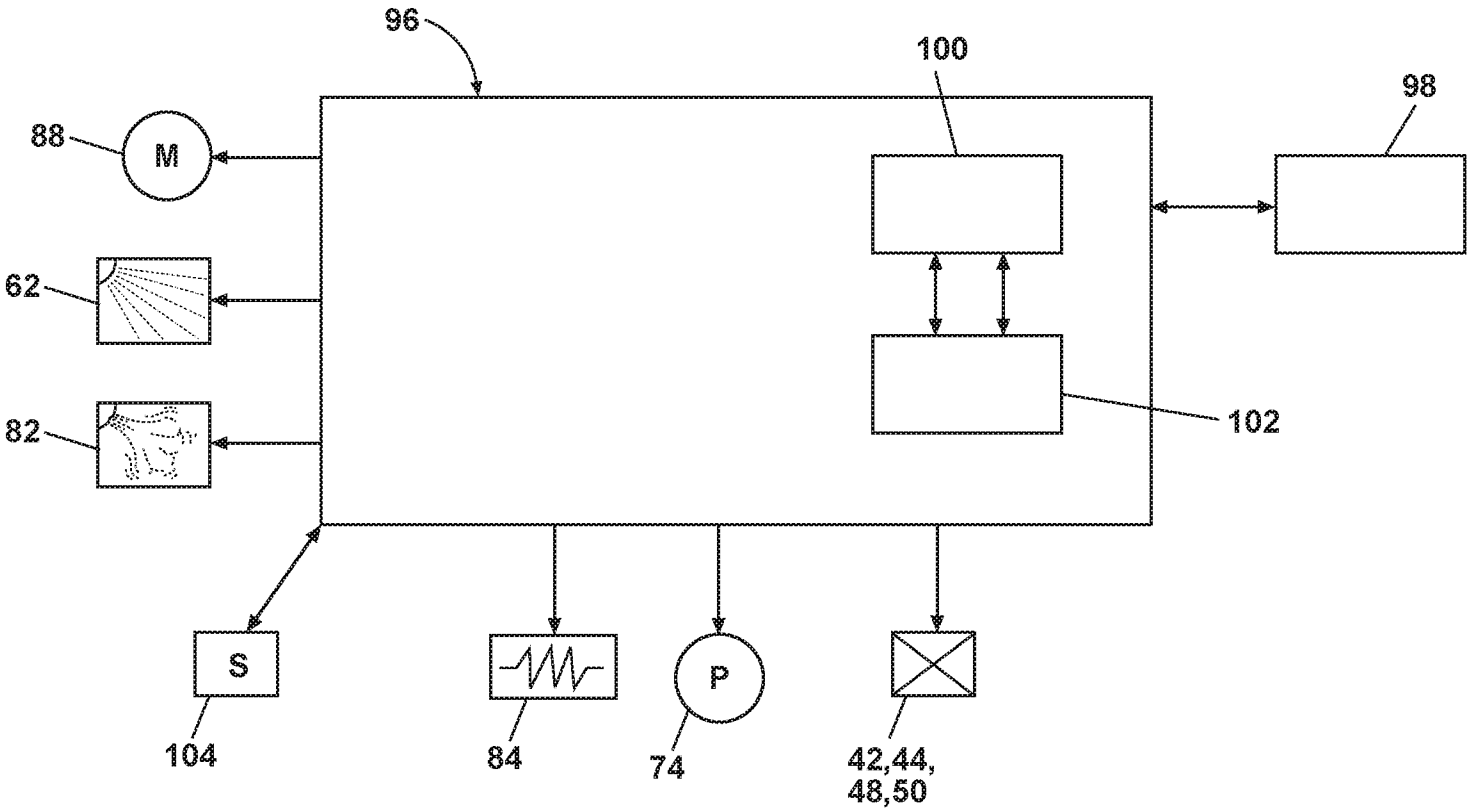
FIG. 2 is a schematic of a control system of the laundry treating appliance of FIG. 1 according to an aspect of the disclosure.

As illustrated in FIG. 2, the controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor and a motor torque sensor, which may be used to determine a variety of system and laundry characteristics, such as laundry load inertia or mass.

Figure 3:
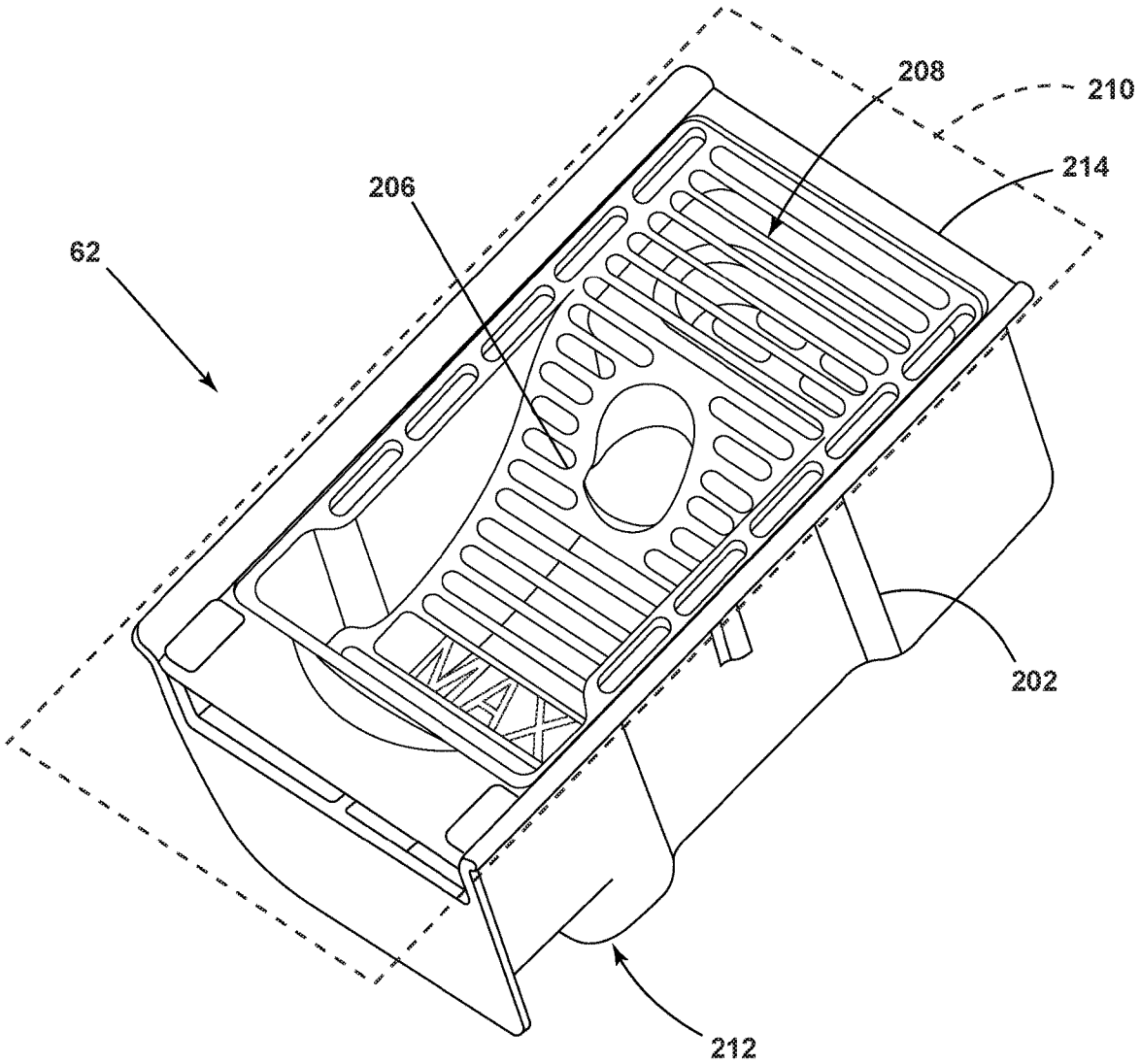
FIG. 3 is an isometric view of a dispenser for a washing machine according to an aspect of the disclosure.
Figure 4:
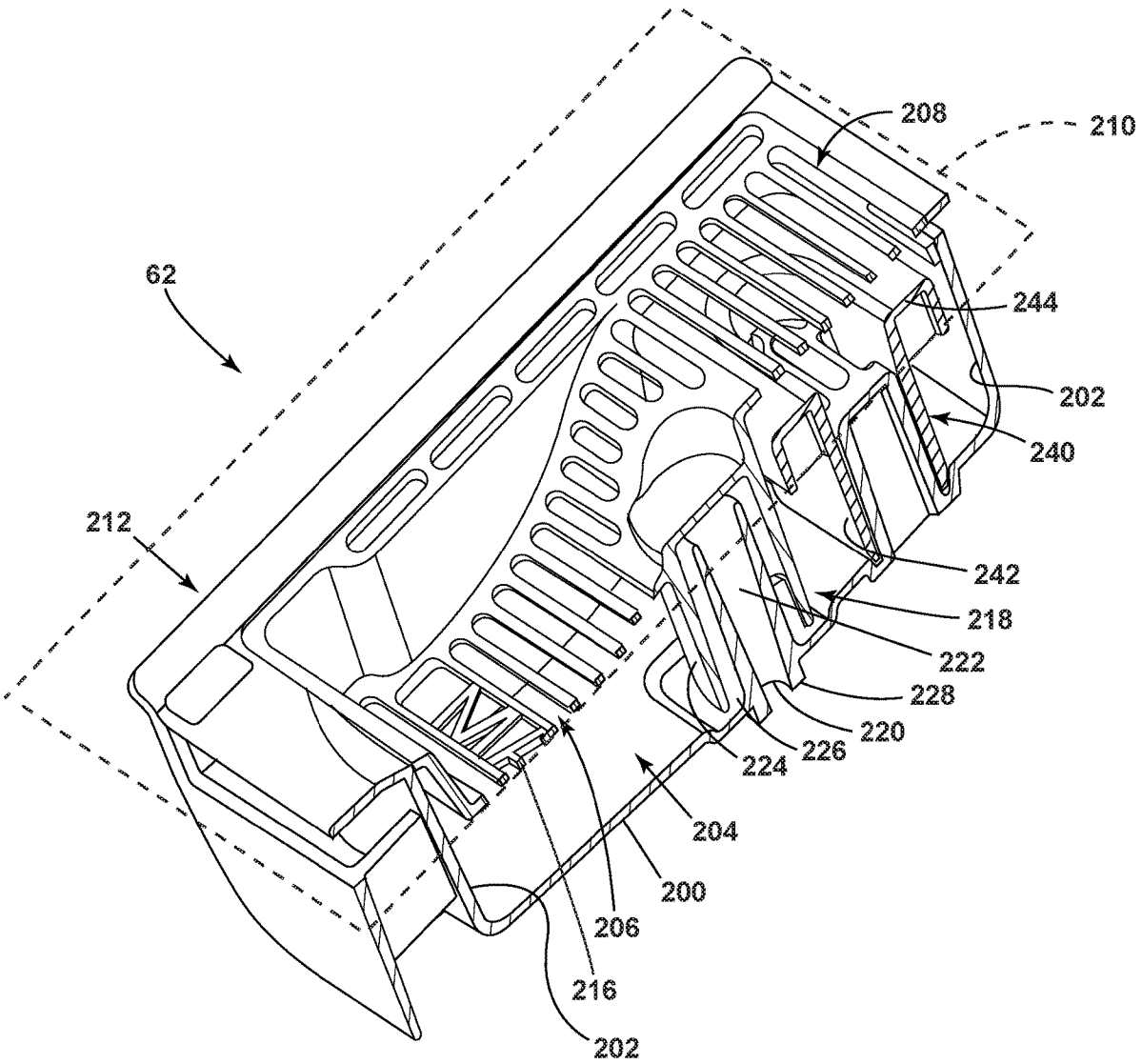
FIG. 4 is a cross sectional view of the dispenser of FIG. 3 taken along lines IV-IV.
Figure 5:
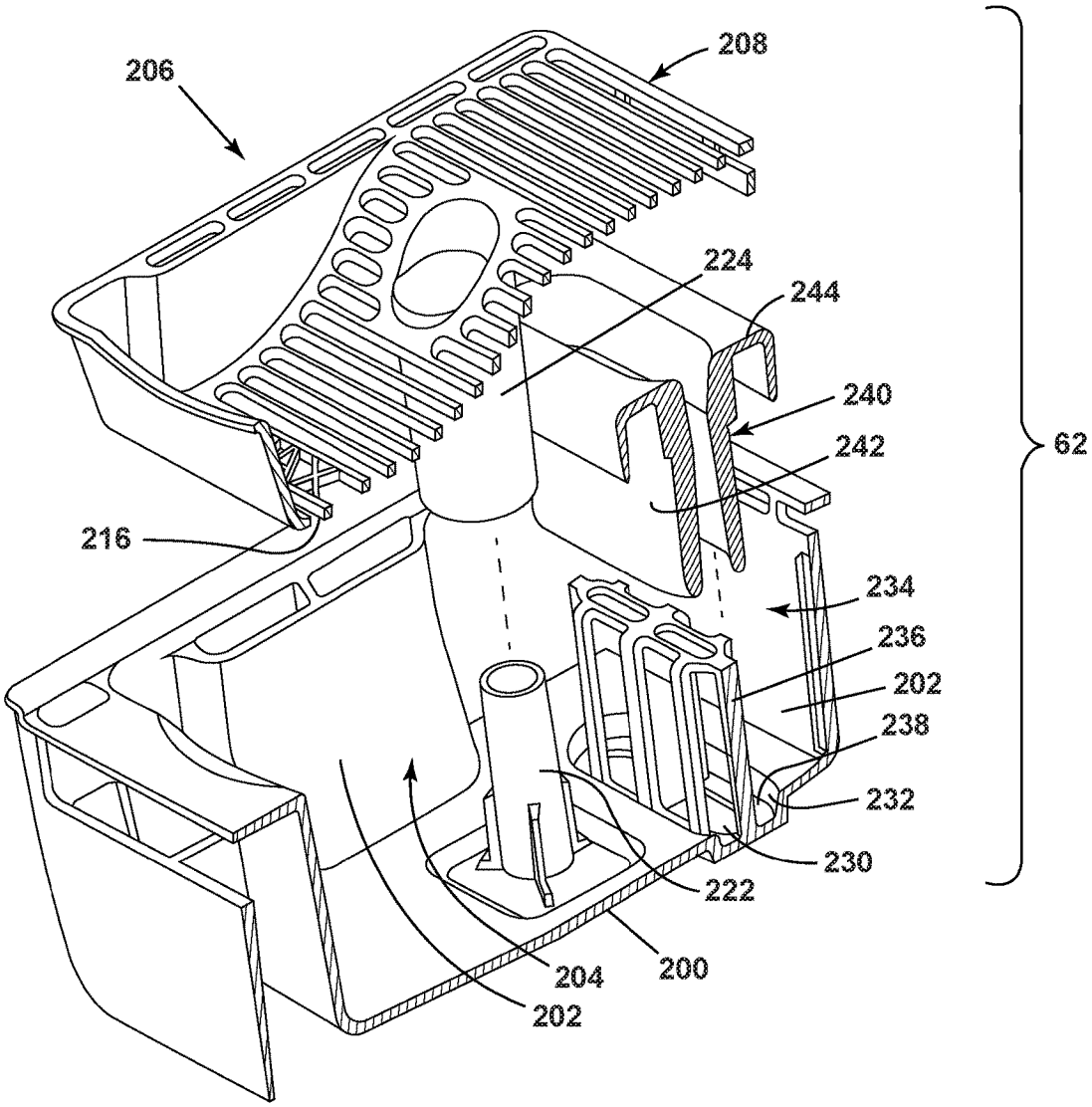
FIG. 5 is an exploded cross-sectional view of the dispenser of FIG. 3 taken along lines V-V.

Referring now to FIGS. 3, 4 and 5, the dispenser 62 is in the form of a drawer, having a bottom wall 200 and side walls 202 that define an open receiving chamber 204. A grid insert 206 covers the open receiving chamber 204 and has a latticework 208 that slopes from a max plane 210 at a proximal end 212 of the open receiving chamber 204 to a top plane 214 of the open receiving chamber 204. The latticework 208 may include a visual indicium 216 of the max plane 210.

A siphon 218, coincident with a siphon opening 220 in the bottom wall 200, extends from the bottom wall 200 toward the top plane 214, preferably midway between opposing side walls 202, and between the proximal end 212 and a point where the latticework 208 meets the top plane 214. The siphon 218 is preferably formed by a hollow tube 222 that surrounds the siphon opening 220 and a hollow cover 224 that depends from the latticework 208 and which is sized to be spaced from the hollow tube 222 when the latticework 208 is mounted to the side walls 202. A siphon gap 226 is provided between a bottom end of the hollow cover 224 and the bottom wall 200 when the when the latticework 208 is so mounted. A nipple 228 is provided at the siphon opening 220 outside the open receiving chamber 204 to enable a connection to the dispensing supply conduit 64 (See FIG. 1) to carry away liquid being siphoned through the siphon opening 220 directly to the tub 14 or by way of the dispensing nozzle 66.

A solids disposal opening 230 is located in a recess 232 in the bottom wall 200 between the siphon opening 220 and a distal end 234 of the open receiving chamber 204, beneath the portion of the latticework 208 coincident with the top plane 214. The solids disposal opening 230 is configured to connect to the dispensing supply conduit 64 (See FIG. 1) to carry away flushed solids from the dispenser 62 directly to the tub 14 or by way of the dispensing nozzle 66. An open cage 236 over the solids disposal opening 230 extends from the recess toward the top plane 214, leaving a flushing gap 238 between the cage and bottom wall 200 in the recess 232. A buoyant float 240 is received over the open cage 236 and has a depending wall 242 that, in a closed position, surrounds the open cage 236 in the flushing gap 238 to close off the solids disposal opening 230. The buoyant float 240 is thus movable vertically over the open cage 236 between the closed position and an open position where the depending wall 242 surrounds the open cage 236 but is displaced from the flushing gap 238, enabling fluid to move through the flushing gap and into the solids disposal opening 230. An outwardly extending flange 244 at a top of the buoyant float 240 may assist in the buoyancy of the float 240 and serve as a stop when it contacts the latticework 208 as the float 240 is buoyed on a fluid. Preferably, the buoyant float 240 is configured to float and open the solids disposal opening 230 as a fluid level in the open receiving chamber 204 reaches above the max plane 210.

Figure 6:
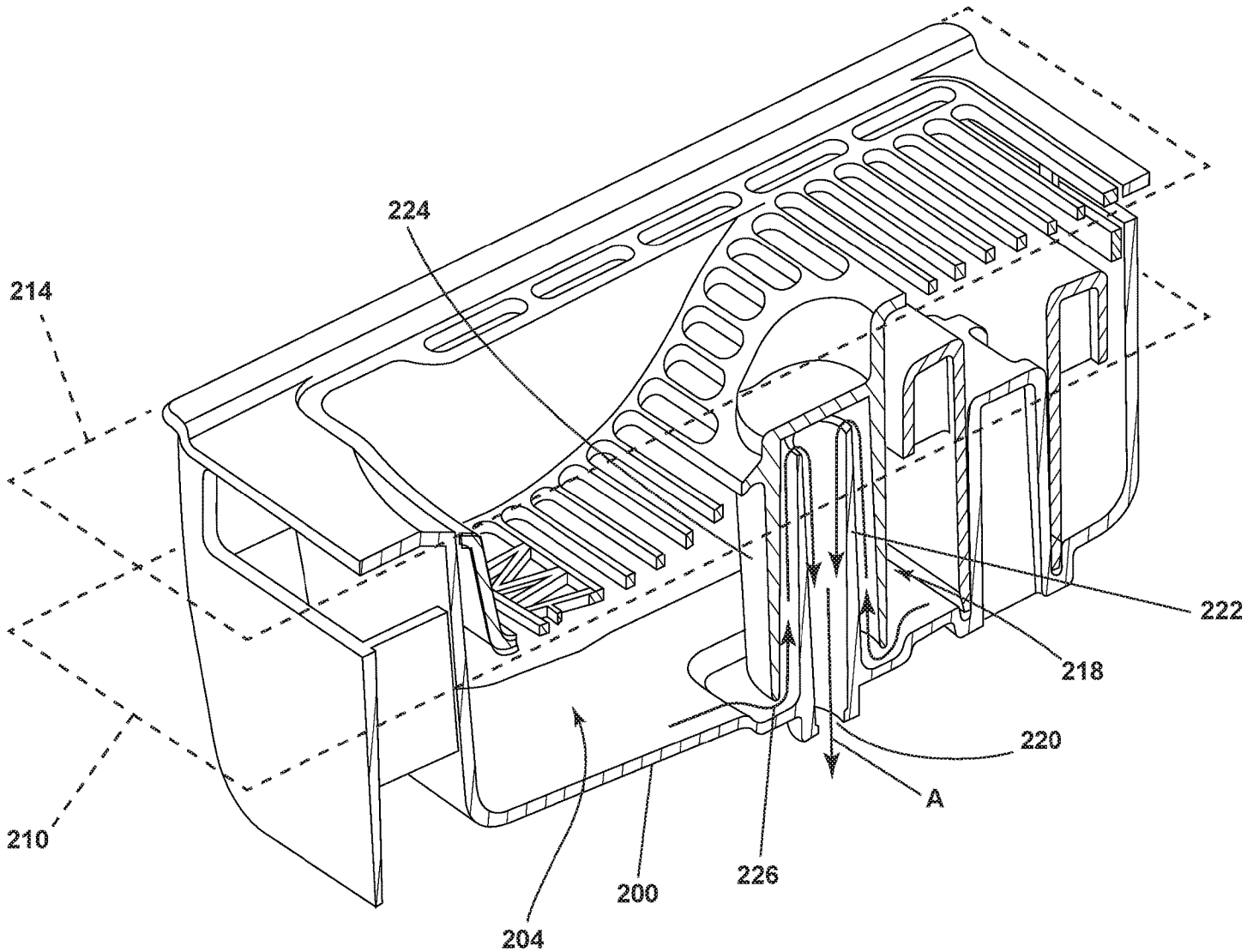
FIG. 6 is the cross-sectional view of FIG. 4 showing activation of the siphon when a liquid treating chemistry reaches a MAX level.

Assume an operation where a user disposes a liquid treating chemistry in the open receiving chamber 204, as shown in FIG. 6. The user may dispose an amount of liquid treating chemistry not to exceed the max plane 210. When a cycle of operation of the washing machine 10 requires the treating chemistry to be moved from the dispenser 62 into the tub 14 (see FIG. 1), the controller 96 will cause the liquid treating chemistry to be siphoned through the siphon 218 and the siphon opening 220 in the bottom wall 200 along the path shown by arrow A. Fluid moves through the siphon gap 226, upwardly between the cover 224 and the hollow tub 222, and then into the hollow tube 222, through the siphon opening 220 and into the dispensing supply conduit 64 (see FIG. 1). If the amount of liquid treating chemistry is below the max plane 210, the siphoning may be enhanced by the additional fluid directed to the open receiving chamber 204 from the dispensing supply conduit 68.

Figure 7:
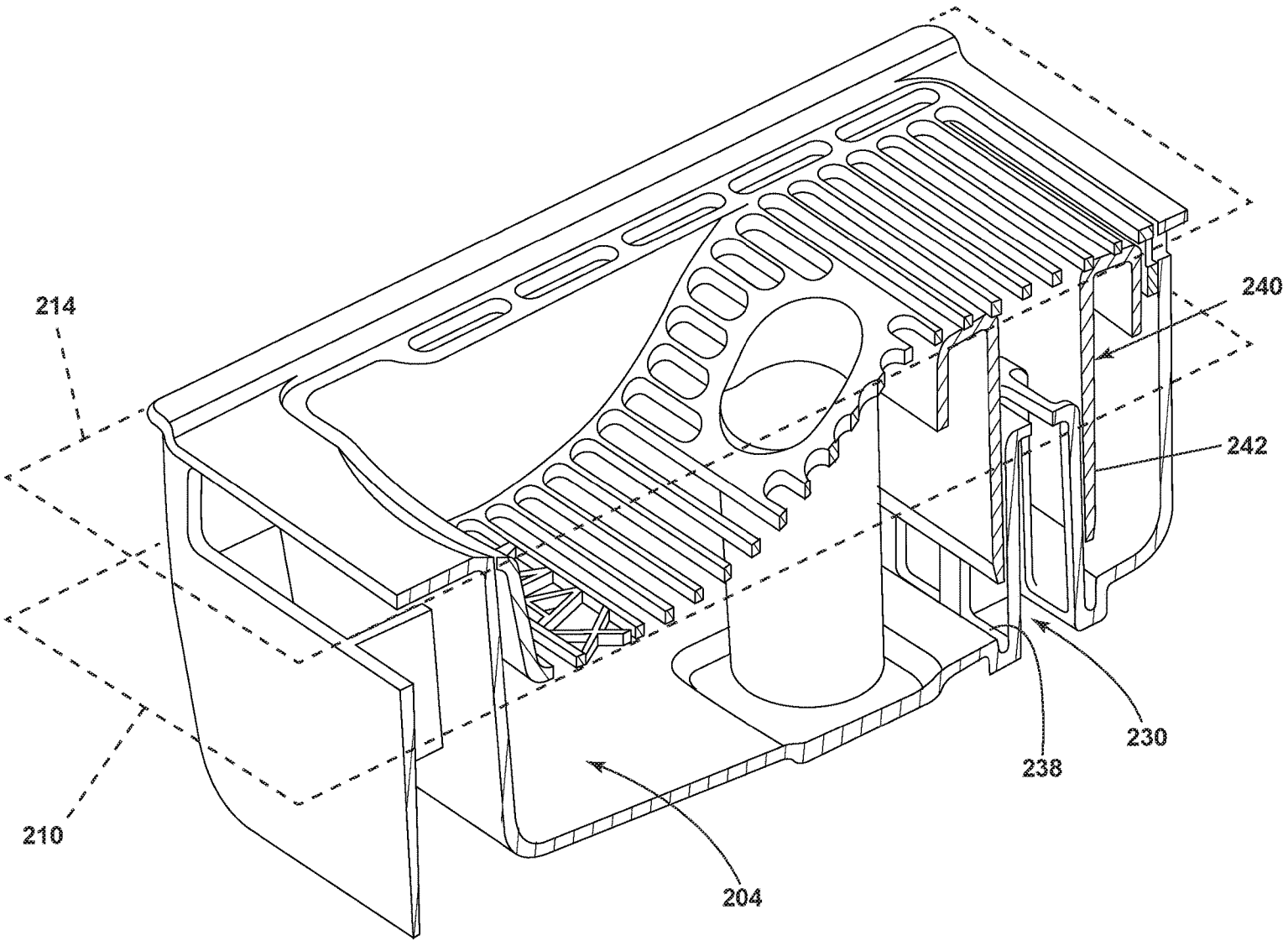
FIG. 7 is the cross sectional view of FIG. 5 showing activation of the floater when a solution of a powder treating chemistry exceeds a MAX level.

Assume now an operation where a user disposes a solid treating chemistry in the form of a powder in the open receiving chamber 204, as shown in FIG. 7. The user may dispose an amount of powder treating chemistry not to exceed the max plane 210. When a cycle of operation of the washing machine 10 requires the treating chemistry to be moved from the dispenser 62 into the tub 14, the controller 96 will cause a fluid to be added to the open receiving chamber 204 from the dispensing supply conduit 68, which in turn will cause the buoyant float 240 to rise as the fluid level passes the max plane 210. As the buoyant float 240 rises, the solids disposal opening 230 is exposed to the open receiving chamber 204 through the flushing gap 238, and the powder is flushed by the fluid through the solids disposal opening 230 and into the dispensing supply conduit 64 (see FIG. 1). The buoyant float 240 rises until the outwardly extending flange 244 is stopped by the latticework 208 at the top plane 214. When fluid flow through the solids disposal opening 230 ceases, the buoyant float 240 sinks until the depending wall 242 closes the solids disposal opening 230.

Thus, it is seen that a single dispenser is capable of handling both liquid and solid treating chemistries, without the user having to move walls, or removing parts, or otherwise reconfiguring the dispenser.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance comprising:

a laundry treating chamber;

a treating chemistry dispenser comprising:

a container defining an open receiving chamber configured to hold a single dose of either a solid or liquid treating chemistry and having a siphon outlet fluidly coupled to the treating chamber and a drain outlet fluidly coupled to the treating chamber;

a siphon located in the receiving chamber and selectively fluidly coupling the siphon outlet to the treating chamber when liquid in the receiving chamber reaches a first level;

a float located in the receiving chamber and selectively fluidly coupling the drain outlet to the treating chamber when liquid in the receiving chamber reaches a second level, greater than the first level; and a grid insert overlaying the open receiving chamber and covering at least the siphon and the float, wherein a top of the float comprises a flange that abuts an underside of the grid insert when liquid in the receiving chamber reaches the second level, wherein liquid treating chemistry is dispensed through the siphon outlet when liquid in the receiving chamber reaches the first level and solid treating chemistry is dispensed through the drain outlet when the liquid in the receiving chamber reaches the second level.

2. The laundry treating appliance of claim 1 further comprising an indicia indicating the first level.

3. The laundry treating appliance of claim 2 wherein the indicia is a grid insert located within the receiving chamber.

4. The laundry treating appliance of claim 3 wherein the grid insert is carried by the siphon.

5. The laundry treating appliance of claim 1 wherein the siphon comprises a siphon tube extending from a bottom wall of the container, the siphon tube having a hollow interior defining the siphon outlet, and a siphon cover encasing the siphon tube and terminating above the bottom wall to define an annulus between the siphon cover and siphon tube.

6. The laundry treating appliance of claim 5 wherein the siphon cover has a lower edge spaced above the bottom wall, and a channel is located below the lower edge.

7. The laundry treating appliance of claim 1 further comprising a float guide adjacent the drain outlet and the float is operably coupled to the float guide to control a path of movement for the float between floating and non-floating states.

8. The laundry treating appliance of claim 7 wherein the float guide comprises a frame extending upwardly from a bottom wall of the container.

9. The laundry treating appliance of claim 8 wherein the frame circumscribes the drain outlet.

10. The laundry treating appliance of claim 9 wherein the frame comprises a plurality of openings fluidly coupled to the drain outlet.

11. The laundry treating appliance of claim 9 wherein the float comprises a cap with an interior receiving the frame, the cap having a top and a peripheral wall depending from the top, with the peripheral wall terminating in a lower edge to define an opening to the cap interior.

12. The laundry treating appliance of claim 9 further comprising a channel circumscribing the frame and the drain outlet and the lower edge is received within the channel to seal the drain outlet when the float is in the non-floating position.

13. The laundry treating appliance of claim 12 wherein the cap comprises an air chamber open to the container.

14. The laundry treating appliance of claim 1 wherein the container remains fixed in the treating chemistry dispenser when either the liquid or solid treating chemistry are added to the container.

15. The laundry treating appliance of claim 1 wherein the grid insert covers an entirety of the open receiving chamber.

16. A treating chemistry dispenser comprising:

a container defining an open receiving chamber configured to hold a single dose of either a solid or liquid treating chemistry and having a siphon outlet and a drain outlet;

a siphon located in the receiving chamber and selectively fluidly coupling the siphon outlet to the receiving chamber when liquid in the receiving chamber reaches a first level;

a float located in the receiving chamber and selectively fluidly coupling the drain outlet to the receiving chamber when liquid in the receiving chamber reaches second level, greater than the first level; and a grid insert overlaying the open receiving chamber and covering at least the siphon and the float, wherein a top of the float comprises a flange that abuts an underside of the grid insert when liquid in the receiving chamber reaches the second level.

17. The treating chemistry dispenser of claim 16 wherein the siphon comprises a siphon tube extending from a bottom wall of the container, the siphon tube having a hollow interior defining the siphon outlet, and a siphon cover encasing the siphon tube and terminating above the bottom wall to define an annulus between the siphon cover and siphon tube.

18. The treating chemistry dispenser of claim 16 further comprising a grid insert carried by the siphon and having an indicium indicating the first level.

19. The treating chemistry dispenser of claim 16 further comprising a float guide adjacent to a float opening and the float is operably coupled to the float guide to control a path of movement for the float between floating and non-floating states.

20. The treating chemistry dispenser of claim 19 wherein the float comprises a cap with an interior receiving the float guide, the cap having a top and a peripheral wall depending from the top, with the peripheral wall terminating in a lower edge to define an opening to the cap interior.

21. The treating chemistry dispenser of claim 20 wherein the cap comprises an air chamber open to the container.

22. The treating chemistry dispenser of claim 19 further comprising a channel circumscribing the float guide and the float opening, and the lower edge is received within the channel to seal the drain outlet when the float is in the non-floating position.

23. The treating chemistry dispenser of claim 16 wherein liquid treating chemistry is dispensed through the siphon outlet and solid treating chemistry is dispensed through the drain outlet.

* * * * *